United States Patent [19]

Butka

[11] Patent Number: 4,681,053

[45] Date of Patent: Jul. 21, 1987

[54] VESSEL SUCH A SHIP, BOAT AND THE LIKE PROVIDED WITH STABILIZING MEANS

[76] Inventor: Kemal Butka, 372 Central Park West, New York, N.Y. 10025

[21] Appl. No.: 884,289

[22] Filed: Jul. 11, 1986

Related U.S. Application Data

[63] Continuation-in-part of Ser. No. 792,831, Oct. 25, 1985.

[51] Int. Cl.[4] ..... B63B 39/02

[52] U.S. Cl. ..... 114/122; 114/124

[58] Field of Search ..... 114/122, 124, 191–195, 114/350

[56] References Cited

U.S. PATENT DOCUMENTS 657,286 9/1900 Hitchins ..... 114/192

FOREIGN PATENT DOCUMENTS 796390 4/1936 France ..... 114/124

3661 of 1872 United Kingdom ..... 114/191

*Primary Examiner*—Sherman D. Basinger

*Attorney, Agent, or Firm*—Michael J. Striker

[57] ABSTRACT

A vessel, such as a ship, a boat and the like, comprises a hull having an inner hollow, a movable body located in the inner hollow of the hull, and device for guiding the movable body in the inner hollow of the hull and formed so that when the hull turns about any horizontal axis in a first direction under the action of waves, wind and the like, the body urges to turn the hull back about the same any horizontal axis in a second direction which is opposite to the first direction so as to stabilize the ship.

6 Claims, 4 Drawing Figures

VESSEL SUCH A SHIP, BOAT AND THE LIKE PROVIDED WITH STABILIZING MEANS

CROSS-REFERENCE TO RELATED APPLICATION

This application is a continuation-in-part of application Ser. No. 792,831 filed Oct. 25, 1985.

BACKGROUND OF THE INVENTION

The present invention relates to a vessel such as a ship, a boat and the like. More particularly, it relates to a ship, a boat and the like provided with stabilizing means.

It is known to provide a stabilizing means in ships, boats for the purpose of reducing their rolling motion. In general, the stabilizing means respond to the force of wind and waves and perform corrective actions. An active stabilizer has a preset control, whereby the corrective action in form of counteracting movement takes place simultaneously with the current of the destabilizing movement that causes the rolling of the ship, boat or the like. The know stabilizing means include from simple bilge keels to retractable keels, and more advanced gyrostabilizers. These devices contribute to correcting the disturbances by performing corresponding actions. However, they do not guarantee keeping the ships, boats and the like in a continuous stable and balanced position.

SUMMARY OF THE INVENTION

Accordingly, it is an object of the present invention to provide a vessel, such as a ship, a boat and the like, which avoids the disadvantages of the prior art and reliably stabilizes the vessel.

In keeping with these objects and with others which will become apparent hereinafter, one feature of the present invention resides, briefly stated, in a ship, a boat and the like, which has a hull with an inner hollow, a movable body located in the inner hollow, and means for guiding the movable body so that when the hull turns about any horizontal axis in a first direction under the action of waves, wind and the like, the body is guided by the guiding means so that it urges to turn the hull back about the same any horizontal axis in a second direction which is opposite to said first direction so as to stabilize the ship.

When the ship, boat and the like is designed in accordance with the present invention, the movable body is guided by the guiding means so that it can move, being guided by the guiding means, substantially in any direction in a horizontal plane, along a longitudinal axis, along a transverse axis, and in any direction between these axes.

In a preferred embodiment of the invention, the guiding means includes a guiding member having a guiding surface of a spherical shape, and a spherical member which rolls over the guiding surface of the guiding member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
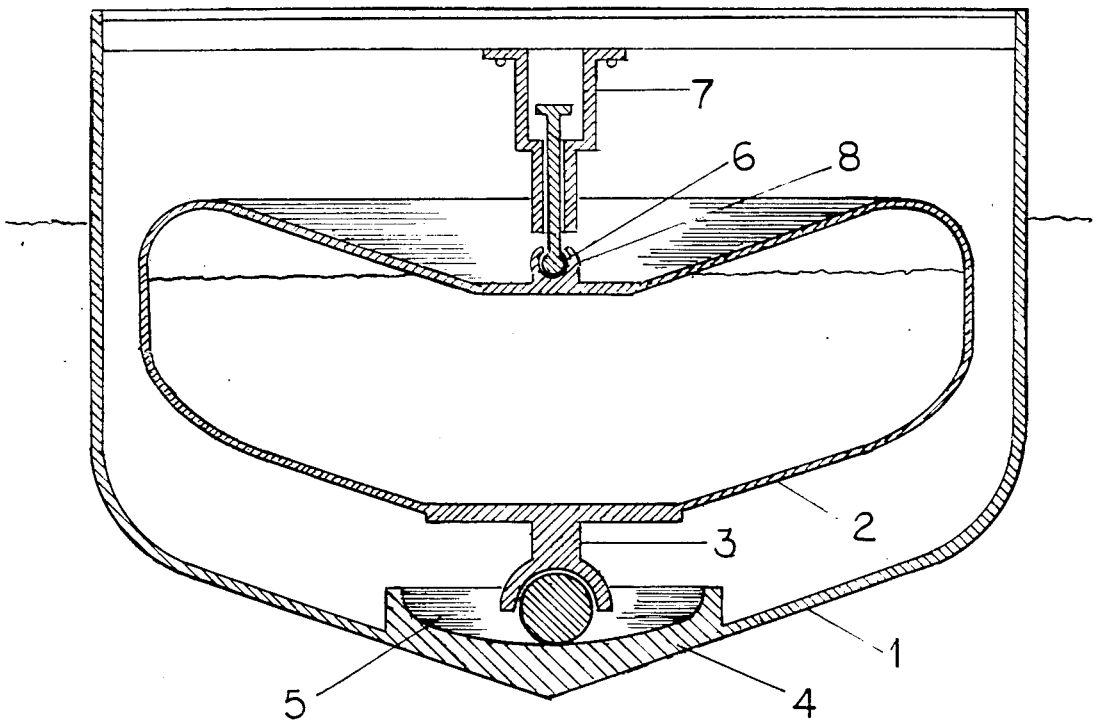
FIG. 1 is a view showing a transverse cross-section of a vessel in accordance with the present invention, in a normal balanced position.

A vessel, for example a ship, has a hull which is identified as a whole with reference numeral 1 and is provided with an inner hollow. A body 2 is located in the inner hollow of the hull 1 and is formed as a ballast. The body 2 can be formed as a solid ballast, a hollow tank filled with water, oil or other liquids, etc.

Guiding means is provided for guiding the body 2 in the inner hollow of the hull 1. The guiding means includes a guiding member which is identified with reference numeral 5. The guiding member 5 has a concave guiding surface. The guiding surface can be formed as a part of a sphere of a great diameter. The guiding means further includes a spherical member 4 which can roll over the guiding surface of the member 5. Finally, the guiding means also include another guiding member 3 which is provided with a receiving opening for the spherical member 4. In the embodiment shown in the drawings, the guiding member 5 is connected with the hull 1, and more particularly is even made of one-piece with the latter. The guiding member 3 is connected with the body 2 and in particular made of onepiece with the latter. The spherical member 4 is held in a spherical recess of the member 3 and rolls over the guiding member 5.

The vessel in accordance with the present invention is further provided with retaining means for retaining the body 2. The retaining means includes a retaining member which is formed as a sleeve 7 having a central opening. A rod 6 is movable in the opening of the sleeve and provided with a spherical end. Retaining means also include another member 8 which is provided with a spherical receptacle for receiving the spherical end of the rod 6. In the shown embodiment the sleeve 7 is fixedly connected to the hull 1, while the second supporting member is fixedly connected with the body 2 and more particularly made of one-piece with the latter.

Figure 2:
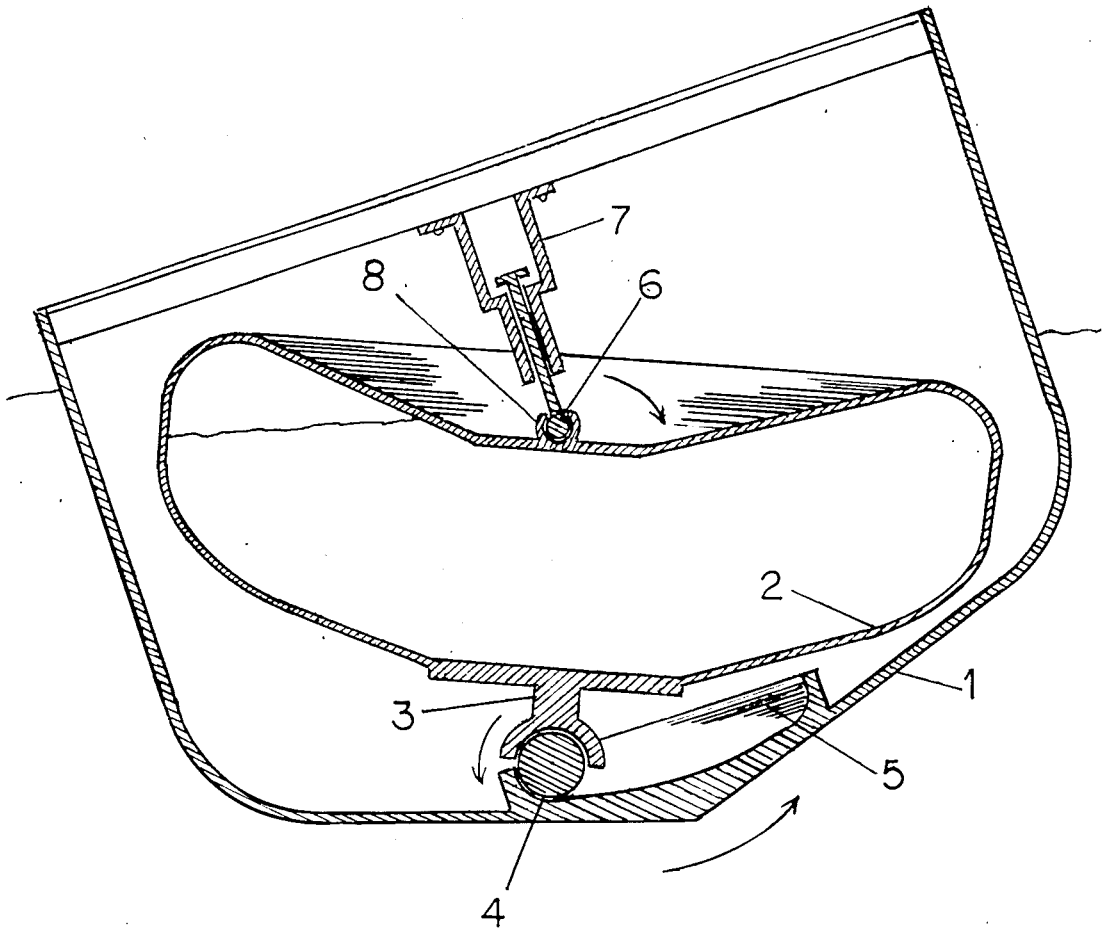
FIG. 2 is a view showing the vessel of FIG. 1 in which under the action of waves or wind movement, a hull of the vessel is inclined.
Figure 3:
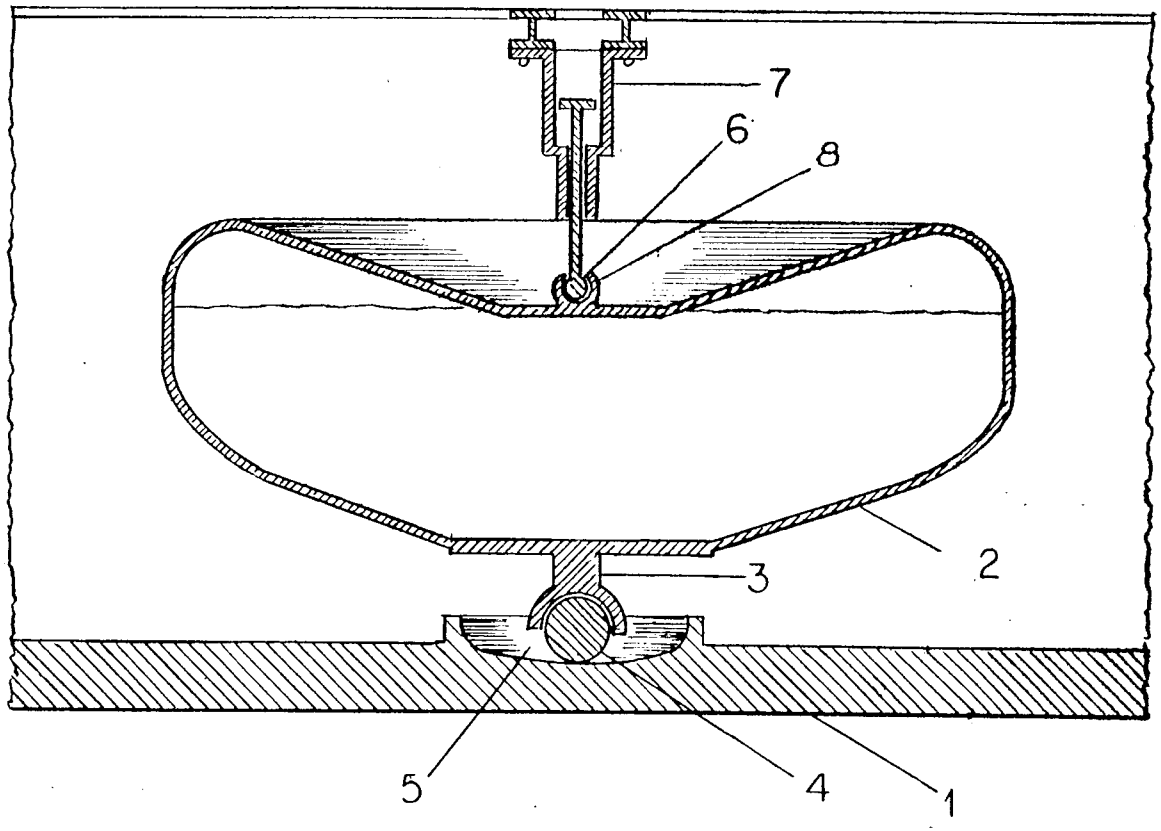
FIG. 3 is a view showing a longitudinal cross-section of the vessel in accordance with the present invention in the normal balanced position.

When waves or wind movement causes turning of the vessel about a longitudinal horizontal axis to an inclined position shown in FIG. 2, a relative movement takes place between the body 2 and the hull 1, with guidance by the guiding means, or more particularly with rolling of the spherical member 4 over the guiding surface of the guiding member 5. This relative movement is controlled by the retaining means and permitted by the latter since the rod 6 displaces along the sleeve 7 and its spherical end turns in the receptacle of the supporting member 8. In the position shown in FIG. 2, the center of gravity of the hull 1 is displaced to the right.

Therefore, a greater part of the body 2 becomes located at the left side of the center of gravity of the hull 1 and thereby urges the hull 1 to turn about the same longitudinal axis back to a stable position.

Figure 4:
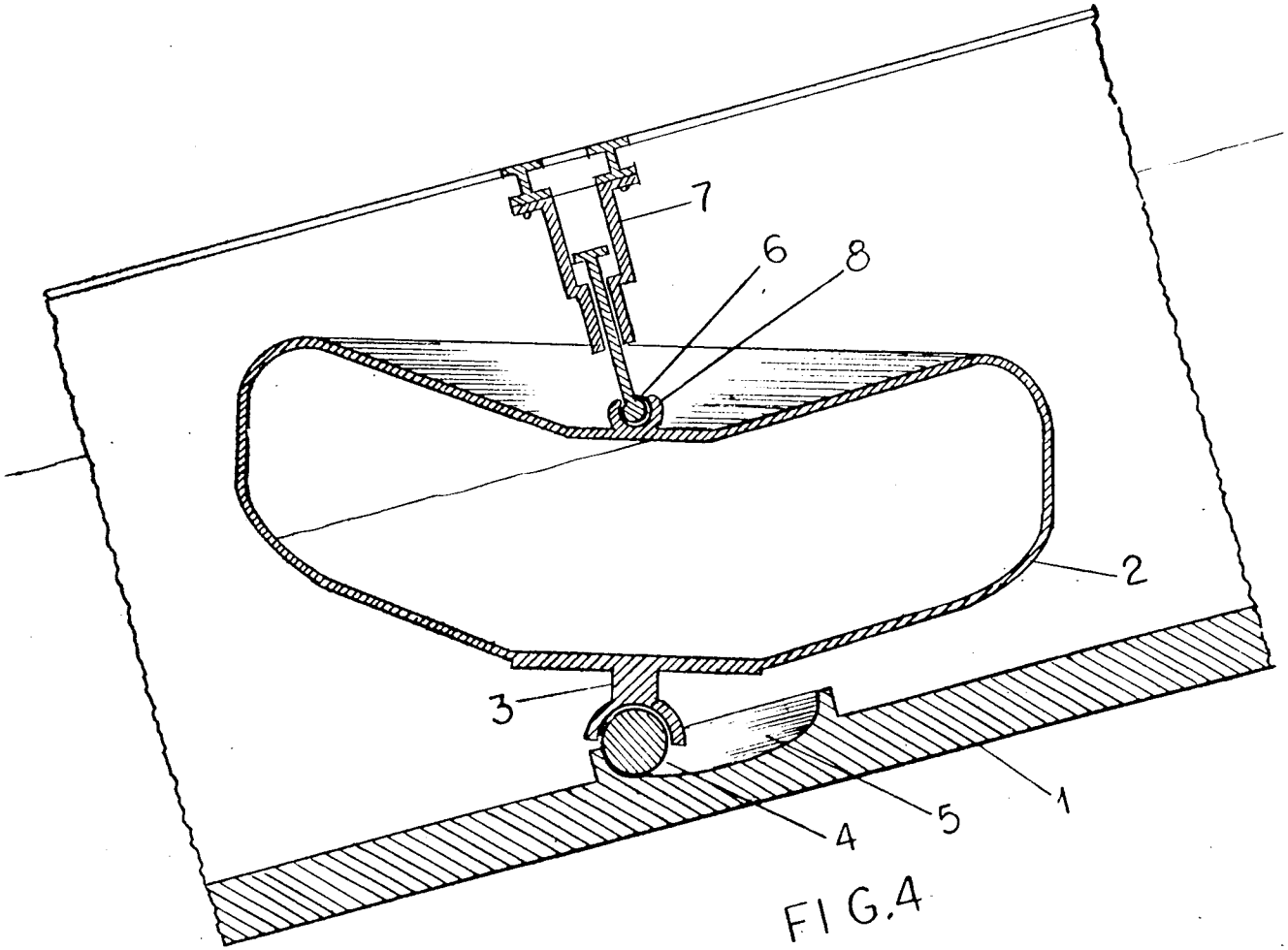
FIG. 4 is a view showing the longitudinal cross-section of the inventive vessel, corresponding to that of FIG. 3, in which under the action of the waves or wind movement, the hull of the ship is inclined.

The same situation takes place when waves or wind movement cause turning of the ship about a transverse horizontal axis to an inclined position shown in FIG. 4. A relative movement takes place between the body 2 and the hull 1 being guided by the guiding means and being restrained and permitted by the supporting means. The center of gravity of the hull displaces to the right in FIG. 4, and the greater part of the body 2 becomes located at the right side of the center of gravity so as to urge the hull to turn back about the same transverse horizontal axis to a stable position. It is to be understood that in a real situation waves or wind movement cause turning of the vessel about any horizontal axis within the range between the transverse horizontal axis and the longitudinal horizontal axis. As described hereinabove, the member 4 is formed spherical and the guiding surface of the guiding member 5 is concave with a concave cross-section in a direction of the longitudinal axis, a transverse axis and any horizontal axis therebetween. Therefore, when the hull is turned by waves or wind movement about any horizontal axis, the relative movement between the body 2 and the hull 1 takes place and the body urges the hull to turn back about the same any horizontal axis. It is therefore believed to be understood that balancing of the ship is performed when the wind or waves act in any direction in a horizontal plane.

The construction of the guiding means and the retaining means described hereinabove is only exemplary. It is believed to be understood that the guiding means can be reversed, so that the guiding member with the concave surface can be provided in the body while the second retaining member which receives the spherical member can be provided in the hull. Similarly, the retaining means can be formed so that the body 2 can be provided with a sleeve, while the rod for the spherical end can be received in the second retaining member connected with the hull. Also, other alternatives are possible.

It will be understood that each of the elements described above, or two or more together, may also find a useful application in other types of constructions differing from the types described above.

While the invention has been illustrated and described as embodied in a vessel, such as a ship, a boat and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vessel, such as a ship, a boat and the like, comprising a hull having an inner hollow; a movable body located in said inner hollow of said hull; and means for guiding said movable body in said inner hollow of said hull and formed so that when said hull turns about any horizontal axis in a first direction under the action of waves, wind and the like, said movable body urges to turn said hull back about the same any horizontal axis in a second direction which is opposite to said first direction so as to stabilize the ship, said guiding means including a spherical body, a guiding member with a guiding surface on which the spherical body can roll, and a holding member provided with a spherical receptacle and arranged to movably hold said spherical body, said hull and said movable body forming two elements, said guiding member being connected with one of said elements, while said holding member is connected with the other of said elements.

2. A vessel as defined in claim 1, wherein said guiding surface of said guiding member is concave and formed as a part of a sphere.

3. A vessel as defined in claim 1, and further comprising retaining means for supporting said movable body and at the same time allowing its movement in said inner hollow of said hull.

4. A vessel as defined in claim 3, wherein said retaining means includes a sleeve-shaped retaining member, and a rod-like member movable in said retaining member.

5. A vessel as defined in claim 4, wherein said rod-like member has a spherical end; said retaining means further comprising a further holding member provided with a spherical receptacle for receiving said spherical end of said rod-like member.

6. A vessel as defined in claim 5, wherein said movable body and said hull form two elements, said sleeve-shaped retaining member being connected with one of said elements, while said further holding member is connected with the other of said elements.

* * * * *